US005871631A

United States Patent [19]

Ichiba et al.

[11] Patent Number: 5,871,631

[45] Date of Patent: Feb. 16, 1999

[54] ACIDIC TIN-PLATING BATH AND ADDITIVE THEREFOR

[75] Inventors: Mikiyuki Ichiba; Hiroshi Kubo; Yoshinori Yomura, all of Fukuyama; Takeshi Miura; Kazuyuki Suda, both of Ohmiya, all of Japan

[73] Assignees: NKK Corporation; LeaRonal Japan Inc., both of Tokyo, Japan

[21] Appl. No.: 784,129

[22] Filed: Jan. 15, 1997

[30] Foreign Application Priority Data

Jan. 30, 1996 [JP] Japan ..... 8-035369

[51] Int. Cl.[6] ..... C25D 3/32

[52] U.S. Cl. ..... 205/302; 205/253; 205/254; 106/1.25

[58] Field of Search ..... 205/302, 253, 205/254; 106/1.25

[56] References Cited

U.S. PATENT DOCUMENTS

| | | | |
|---|---|---|---|
| 4,168,223 | 9/1979 | Igarashi et al. | 204/44 |
| 5,110,423 | 5/1992 | Little et al. | 205/254 |
| 5,174,887 | 12/1992 | Federman et al. | 205/253 |
| 5,296,128 | 3/1994 | Gernon et al. | 205/254 |

FOREIGN PATENT DOCUMENTS

| | | |
|---|---|---|
| 2 409 327 | 6/1979 | France . |
| 3-291393 | 12/1991 | Japan . |
| 4-228595 | 8/1992 | Japan . |

OTHER PUBLICATIONS

Database WPI, Section Ch, Week 8629, Derwent Publications Ltd., London, GB, Class A23, AN 86–185491 of JP 61 117298 A (Nippon Mining Co.), 4 Jun. 1986.

*Primary Examiner*—Kathryn L. Gorgos
*Assistant Examiner*—Kishor Mayekar
*Attorney, Agent, or Firm*—Frishauf, Holtz, Goodman, Langer & Chick, P.C.

[57] ABSTRACT

An additive for an acidic tinplating bath comprises: an additive ingredient (A) prepared by adding oxypropylene to polyoxyethylene glycol and having an average molecular weight ranging from 3000 to 18000; an additive ingredient (B) prepared by adding oxypropylene to polyoxyethylene glycol and having an average molecular weight ranging from 300 to 1500; and the additive ingredient (A) and the additive ingredient (B) having a weight ratio of the additive ingredient (A) to the additive ingredient (B) being from 97/3 to 40/60.

5 Claims, 3 Drawing Sheets

ACIDIC TIN-PLATING BATH AND ADDITIVE THEREFOR

BACKGROUND OF THE INVENTION

1. Field of the Invention

The present invention relates to an acidic tinplating bath and an additive therefor.

2. Description of the Related Arts

Organic sulfonic acid bath is mainly used in conventional tinplating bath to apply electro-tinplating on a steel sheet for manufacturing cans. In particular, ferrostanate bath is widely used which uses PSA (phenol sulfonic acid) as the organic sulfonic acid and aromatic sulfonic acid such as ENSA (ethoxynaphthol sulfonic acid) as the brightening agent.

Ferrostanate bath has, however, a problem that the bath fails to provide surface brightness requested for tin can material and to provide adequate corrosion resistance after the reflow treatment (tin fusion heating) if the electrolytic condition falls in outside of adequate range. Accordingly, the operating range of the ferrostanate bath is limited to approximate electrolysis condition range from 20 to 30 A/dm$^2$ even in a line speed range from 200 to 400 m/min., and the ferrostanate bath has problems of many limitation in operating conditions and of low productivity. In addition, ferrostanate bath needs many electrolytic cells to obtain a specified tin coating weight so that this type of bath is inferior in investment cost. Furthermore, ferrostanate bath has recently raised a problem of bad influence to environment.

To solve these problems of ferrostanate bath, various types of baths relating to the continuous tinplating of steel sheet have been introduced. Among them, a bath based on MSA (methane sulfonic acid), an alkanesulfonic acid, draws attention as a continuous electro-tinplating bath for steel sheet switching from the ferrostanate bath because the bath is suitable for high current density electrolysis owing to less electrolytic conductivity compared with the PSA-based ferrostanate bath and because the bath generates less bad influence to environment.

Performance of plating bath used for tinplating is significantly affected not only by the type of organic sulfonic acid as the basis but also the additive used in combination therewith. Consequently, many kinds of additives were proposed also for a bath that uses MSA (methane sulfonic acid) as the basis.

Nevertheless, most of these proposed additives are used in tin-lead alloy plating such as solder plating and bright electroplating in electronics devices. As for the additives in matte electrodeposition used for continuous tinplating process of steel sheet, not many proposals were made, and only the following disclosures have been given.

Japanese unexamined patent publication No.4-228595 discloses an additive used in a continuous electro-tinplating process of steel sheet. According to the disclosure, the additive is an alkylene oxide condensation compound of an aromatic hydrocarbon, or an alkylene oxide condensation compound of an aliphatic compound having at least one hydroxyl group and having 20 or less of carbon atoms and containing 20 moles or less of oxide. The disclosure describes the evaluation on the performance of additive using a Hull cell under the electrolytic condition of 2 Ampere and low flow environment to determine post-electroplating appearance, cloud point and foamability. However, the disclosure does not give quantitative description on the evaluation other than the cloud point, and no quantitative suitability in a high speed and high current density operation is shown.

Japanese Unexamined Japanese patent publication No.3-291393 discloses a compound prepared by adding 20 moles or less of ethylene oxide and propylene oxide to α-naphthol and sulfonating it as an additive used in a continuous electro-tinplating process of steel sheet. The use of the additive aims to operate the process under a high speed and high current density condition. The disclosure gives evaluation of uniform electrodeposition, solubility of additive, and foaming property after the electrolysis at 50 A/dm$^2$ in high flow environment. The disclosure, however, does not give any evaluation on post-electrolysis appearance which is an important variable of post-tinplating quality.

Based on the above-described prior arts, the inventors conducted investigation and study on additives which are applicable to tinplating bath of alkanesulfonic acid basis and which provide a wide range of current density and an increased upper limit of current density.

The evaluation of additives was given through the bath-preparation and plating under a constant condition of basis bath composition except for the additives and under a constant plating condition except for the current density, and through the evaluation of performance of the electrolytic characteristics and the evaluation of performance of the obtained plated steel sheet (plated deposit). The performance evaluation of the plated steel sheet was conducted mainly on the post-reflow brightness which is an important quality item of the tinplated steel sheet used for can material.

The result revealed that the brightness obtained in laboratory reflow treatment gives poor reproducibility owing to the influence of kinds and quantity of fluxes used in the reflow treatment, to the wettability of specimens, and to the heating pattern in the reflow treatment, and that accurate quantitative evaluation is difficult to derive.

Particularly in a tinplating bath of alkanesulfonic acid basis, the morphologic change of plated deposit against the increase in the plating current density differed from that in existed ferrostanate bath. That is, the increase in current density induced gradual change of crystal structure from fine and dense submicron crystals to coarse crystals of 1 μm or larger size and further to dendrite. It was also found that the coarse crystal structure which is not observed in ferrostanate bath changed responding to the composition of the plating bath and to the kind of additive applied, and that post-reflow brightness was attained in some cases and could not be attained in other cases. However, the evaluation of brightness after the reflow treatment could not be performed from the structure of plated deposit before the reflow treatment. Furthermore, change in electrolysis behavior and change in brightness before reflow treatment against the plating current density did not agree with the change in crystal structure of coarse grains nor with the post-reflow brightness.

Accordingly, the tinplating bath of alkanesulfonic acid basis is difficult to give relative evaluation of additive performance because there is no accurate method for evaluating bath performance including post-reflow brightness. Thus there existed a serious problem of difficulty in developing and selecting additives for tinplating bath having excellent characteristics of high current density electrolysis.

SUMMARY OF THE INVENTION

It is an object of the present invention to provide an acidic tinplating bath and an additive therefor by which electrolysis is improved under a high current density tinplating.

To attain the object, the present invention provides an additive for an acidic tinplating bath to electroplating tin to a continuously moving steel sheet, the additive comprising:

an additive ingredient (A) prepared by adding oxypropylene to polyoxyethylene glycol and having an average molecular weight ranging from 3000 to 18000;

an additive ingredient (B) prepared by adding oxypropylene to polyoxyethylene glycol and having an average molecular weight ranging from 300 to 1500; and the additive ingredient (A) and the additive ingredient (B) having a weight ratio of the additive ingredient (A) to the additive ingredient (B) being from 97/3 to 40/60.

It is preferable that the additive ingredient (A) has a ratio of molar number of ethylene oxide to molar number of propylene oxide being from 1 to 14 and the additive ingredient (B) has a ratio of molar number of ethylene oxide to molar number of propylene oxide being from 0.4 to 3.

Furthermore, the present invention provides an acidic tinplating bath for electroplating tin to a continuously moving steel sheet, the acidic tinplating bath comprising:

a divalent tin salt of a organic sulfonic acid using at least one organic sulfonic acid selected from the group of alkanesulfonic acid and alkanolsulfonic acid; an antioxidant; and a brightening agent which is contained in an amount of from 0.2 to 20 g/liter of the acidic tinplating bath.

The above-mentioned additive is used as the brightening agent for the acidic tinplating bath.

DESCRIPTION OF THE EMBODIMENT

The inventors conducted study to establish an accurate evaluation method on the plating bath performance including post-reflow brightness to select an additive for plating bath aiming at the improvement of characteristics of high current density electrolysis for a tinplating bath of alkanesulfonic acid basis. Thus the inventors found that an adequate crystal orientation in the plated deposit before reflow treatment gives an accurate evaluation of brightness performance after the reflow treatment.

The finding is described below. First, in a tinplating bath of alkanesulfonic acid basis, it was found that when electrolysis time is constant, the increase in plating current density induces the increase of orientation intensity of (101) plane, expressed by eq.(3) given below, followed by reaching a peak then decreasing thereof. The reduction of orientation intensity of (101) plane after reaching the peak suggests the effect of change of plated deposit to dendrite. Thus the reduction of orientation intensity of (101) plane was found to degrade the performance of brightness and corrosion resistance. The tendency was not changed in baths of alkanesulfonic acid basis with various kinds of bath compositions and additive ingredients. The orientation intensity of (200) plane in the plated deposit, which is expressed by eq.(5) given below, was found to show nearly opposite change to the change of orientation intensity of (101) plane against the plating current density. It was also found that, even when there is no difference in the change of orientation intensity of (101) plane against the plating current density, higher minimum value of the orientation intensity of (200) plane gives further fine and dense crystals if there is a difference in the change of orientation intensity of (200) plane against the plating current density.

The characteristics of high current density electrolysis of a plating bath containing additive were evaluated using a method described below to select an additive.

Figure 1:
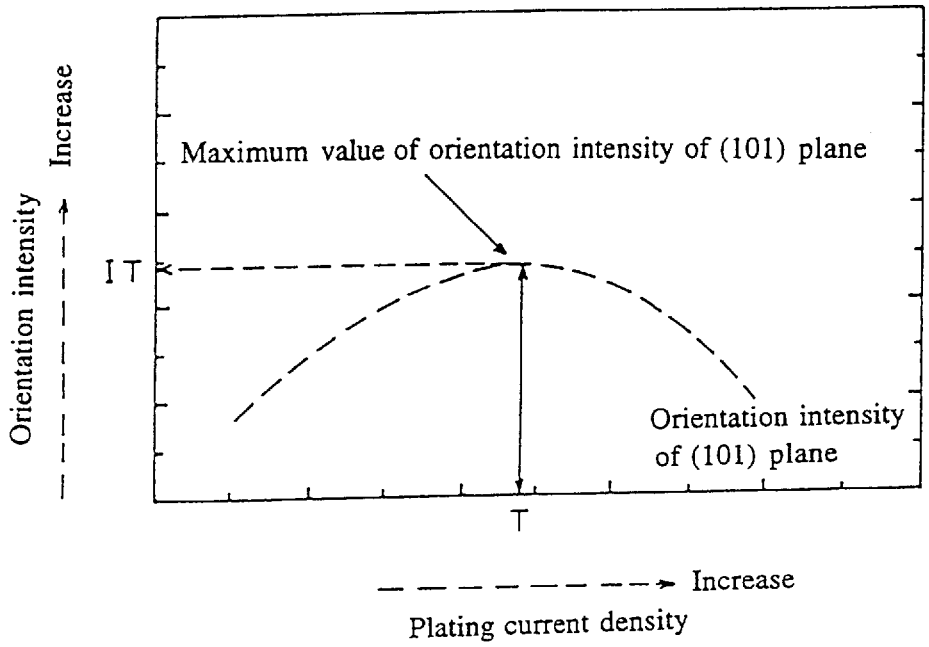
FIG. 1 is a schematic drawing showing the concept of T value which is the first evaluation index of the characteristics of high current density electrolysis of tinplating bath.

The plating current was changed in a range from 30 to 200 $A/dm^2$ at an approximate interval of 5 to 20 $A/dm^2$. The electrolysis time was constant. Plating was conducted in the same plating bath with different current densities to prepare 9 to 15 levels of plated deposits. Each of the prepared plated deposits was subjected to peak search by XRD measurement. From the observed peak intensity of (101) plane for a β-tin, (eq.(1) given below), and the total peak intensity, (eq.(2) given below), the orientation intensity of (101) plane of each plated deposit was determined using eq.(3) given below. Thus derived a curve correlating the orientation intensity of (101) plane of the plated deposit with the plating current density at which the deposit was plated in the same plating bath, or a curve showing the change of orientation intensity of (101) plane in the plated deposit with the increase in plating current density. The vertical axis is the orientation intensity of (101) plane, and the horizontal axis is the plating current density. The plating current density at the point that the maximum value IT of the orientation intensity of (101) plane on the curve is defined as T. The value of T is taken as the first evaluation index for the characteristics of high current density electrolysis of the plating bath. That is, higher value of T means higher upper limit of the current density of the plating bath and suggests superior characteristics of high current density electrolysis. FIG. 1 shows the concept of T value.

Figure 2:
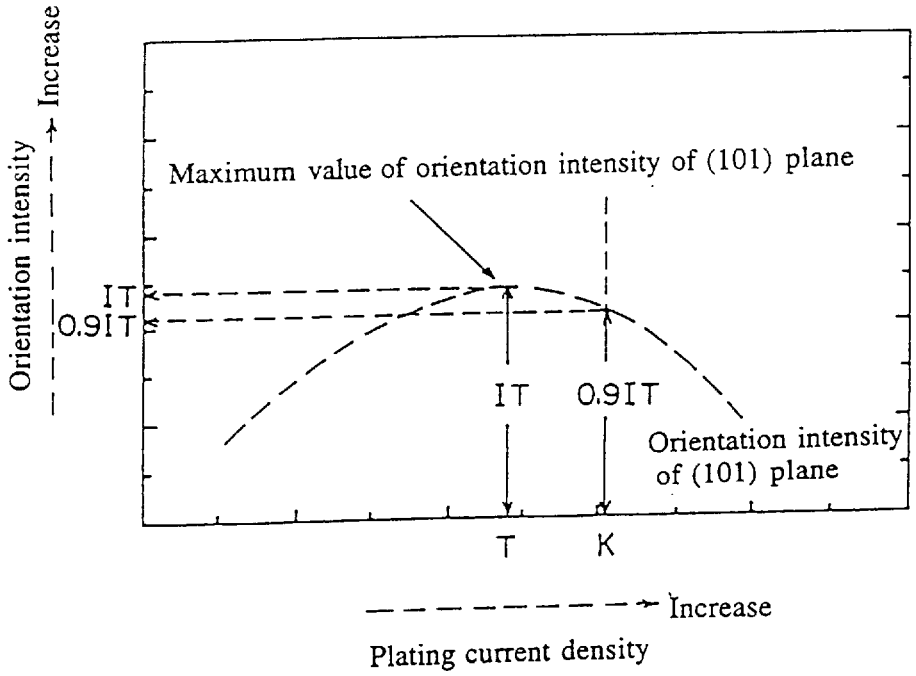
FIG. 2 is a schematic drawing showing the concept of K value which is the second evaluation index of the characteristics of high current density electrolysis of tinplating bath.

For the case that the T value as the first evaluation index is the same, the curve showing the change of orientation intensity of ( 101) plane of the plated deposit against the plating current density is followed to determine the point of 0.9 IT of the orientation intensity of (101) plane, corresponding to 90% of the maximum IT value. The value on the plating current density axis at the 0.9 IT point is defined as K. The K value is defined as the second evaluation index of the characteristics of high current density electrolysis of the plating bath. That is, even when the T value is the same, higher T value gives more gradual decrease of the curve of change in orientation intensity of (101) plane after reached the peak value, and suggests higher upper limit of current density of the plating bath and superior in the characteristics of high current density electrolysis. FIG. 2 shows the concept of the K value.

Figure 3:
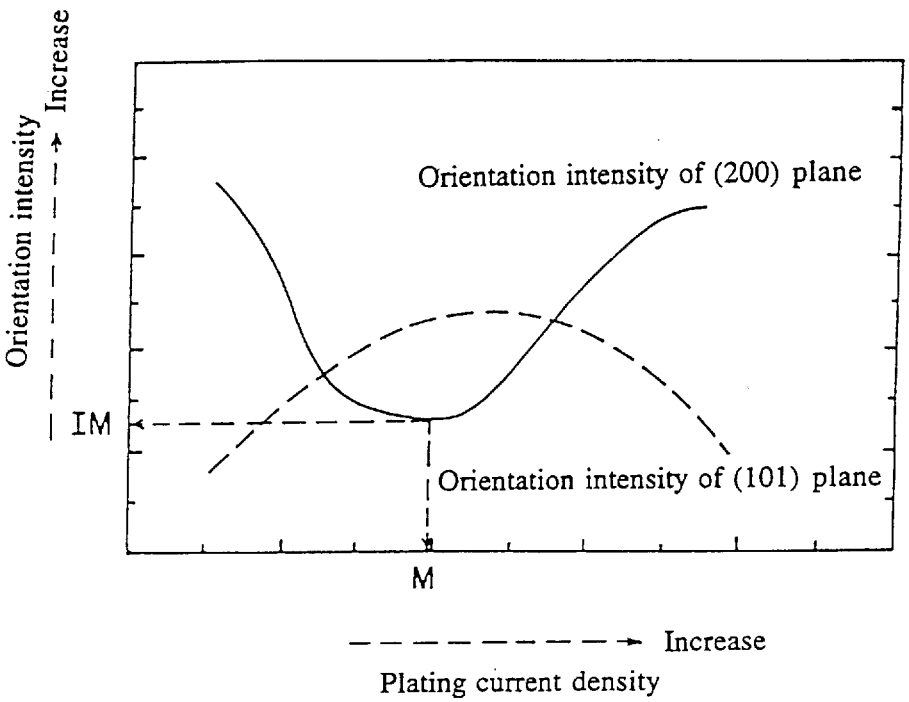
FIG. 3 is a schematic drawing showing the concept of IM value which is the third evaluation index of the characteristics of high current density electrolysis of tinplating bath.

In the case that T value and K value, or the first index and the second index, were the same for separate plated deposits, the orientation intensity of (200) plane of each plated deposit was determined from the peak intensity of (200) plane obtained from the peak search on a β-tin, (eq.(4) given below), and from the total peak intensity, (eq.(2) given below), using eq.(5) given below. Thus derived a curve correlating the orientation intensity of (200) plane of the plated deposit with the plating current density at which the deposit was plated in the same plating bath, or a curve showing the change of orientation intensity of (200) plane in the plated deposit with the increase in plating current density. The vertical axis is the orientation intensity of (200) plane, and the horizontal axis is the plating current density. The minimum value IM of the orientation intensity of (200) plane on the curve is taken as the third evaluation index for the characteristics of high current density electrolysis of the plating bath. That is, even when the T value and the K value are the same in different cases, higher value of IM gives more fine and dense crystals and gives superior characteristics of high current density electrolysis. FIG. 3 shows the concept of the IM value.

Figure 4:
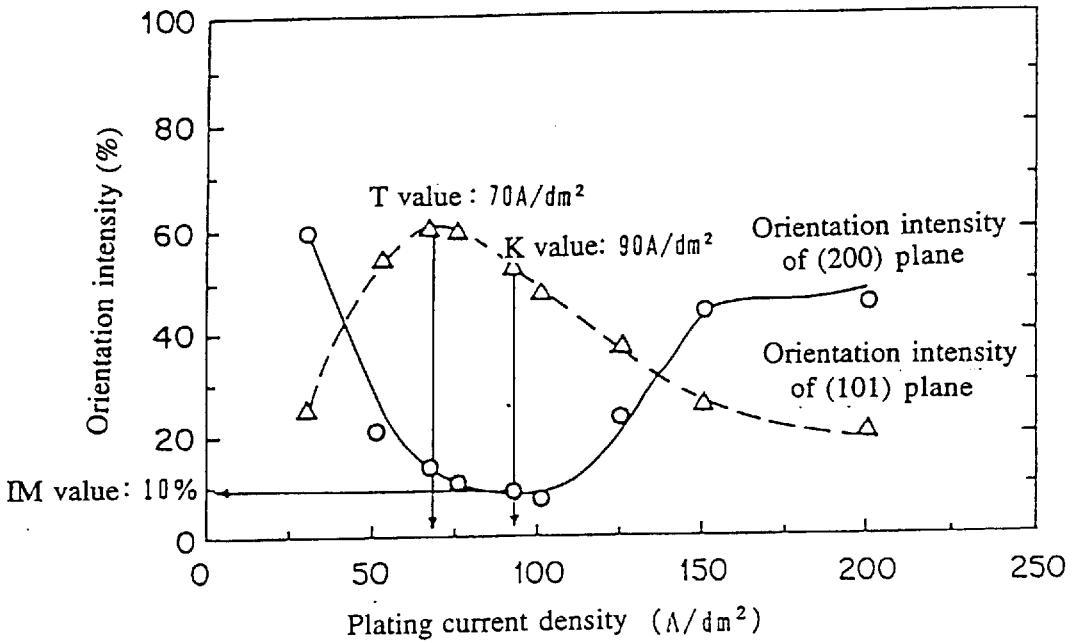
FIG. 4 is a graph showing an example of determined T value, K value, and IM value.
Figure 5:
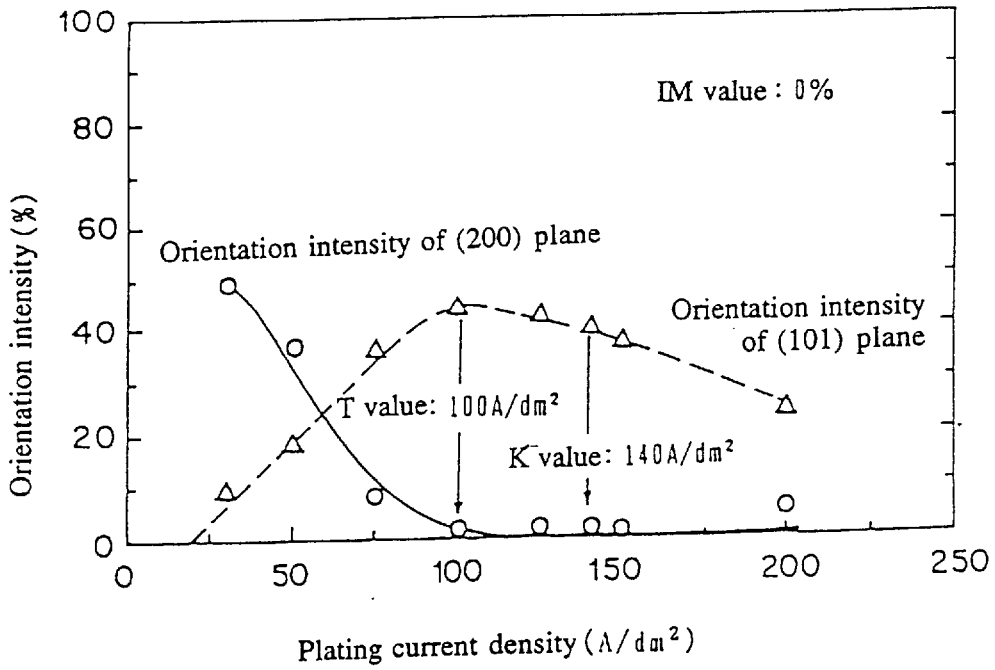
FIG. 5 is a graph showing another example of determined T value, K value, and IM value.

FIG. 4 and FIG. 5 show examples of observed values (on a commercial line) of T value, K value, and IM value.

Iobs(101): Peak intensity of (101) plane of plated deposit of β-tin determined by X-ray diffraction method eq.(1)

ΣIobs: Total peak intensity of plated deposit of β-tin determined by X-ray diffraction method eq.(2)

100×Iobs( 101)/ ΣIobs: Orientation intensity of (101) plane of plated deposit eq.(3)

Iobs(200): Peak intensity of (200) plane of β-tin determined by X-ray diffraction method eq.(4)

100×Iobs(200)/ΣIobs: Orientation intensity of (200) plane of plated deposits eq.(5)

Tinplates of typical grade for can-forming which were plated at a current density not exceeding T value showed favorable corrosion resistance equivalent to that of existing tinplates.

With the addition of various components as the additive separately to the tinplating bath of alkanesulfonic acid basis, the high current density electrolytic performance of each of the baths was evaluated by the above-described evaluation method. The result was that the aliphatic additives gave superior characteristics of high current density electrolysis to the aromatic additives. Among the aliphatic additives, an additive of oxypropylene-added polyoxyethylene glycol showed particularly excellent characteristics of high current density electrolysis. Further detailed investigation revealed that the characteristics of high current density electrolysis of plating bath is affected by the molecular weight of the additive of oxypropylene-added polyoxyethyleneglycol.

It was found that the upper limit of current density applicable to plating bath effectively increased using an additive of a mixture of an additive ingredient (A) prepared by adding oxypropylene to polyoxyethyleneglycol and having an average molecular weight ranging from 3000 to 18000 and an additive ingredient (B) prepared by adding oxypropylene to polyoxyethyleneglycol and having an average molecular weight ranging from 300 to 1500, at a specified blending ratio, and that the use of that type of additive improves the characteristics of high current density electrolysis by about 1.5 fold compared with the case of single additive prepared by adding oxypropylene to polyoxyethyleneglycol.

The present invention was completed on the basis of the established evaluation method of bath performance and on the basis of the findings derived therefrom. The characteristic constitution of the present invention is described below.

[1] An additive for high current density tinplating for an acidic tinplating bath to conduct electrolytic tinplating to a continuously moving steel sheet, which additive comprises an additive ingredient (A) prepared by adding oxypropylene to polyoxyethyleneglycol and having an average molecular weight ranging from 3000 to 18000 and an additive ingredient (B) prepared by adding oxypropylene to polyoxyethyleneglycol and having an average molecular weight ranging from 300 to 1500, at a weight ratio of [additive ingredient (A)]/[additive ingredient (B)] ranging from 97/3 to 40/60.

[2] An additive for high current density tinplating bath described in [1], wherein the ratio [molar number of ethylene oxide]/[molar number of propylene oxide] in the additive ingredient (A) is in a range from 1 to 14, and wherein the ratio [molar number of ethylene oxide]/[molar number of propylene oxide] in the additive ingredient (B) is in a range of from 0.4 to 3.

[3] A tinplating bath having excellent characteristics of high current density electrolysis to conduct acidic tinplating to a continuously moving steel sheet, which bath using at least one organic sulfonic acid selected from the group of alkanesulfonic acid and alkanolsulfonic acid, and containing a divalent tin salt of the organic sulfonic acid, an antioxidant, and a brightening agent, as basic components, wherein the brightening agent contains the additive described in [1] at a content ranging from 0.2 to 20 g/l.

[4] A tinplating bath having excellent characteristics of high current density electrolysis described in [3], wherein the ratio [molar number of ethylene oxide]/[molar number of propylene oxide] in the additive ingredient (A) is in a range from 1 to 14, and wherein the ratio [molar number of ethylene oxide]/[molar number of propylene oxide] in the additive ingredient (B) is in a range from 0.4 to 3.

The present invention is described in more detail in the following along with the reason of specification.

One component of the additive of the present invention, or additive ingredient (A) prepared by adding oxypropylene to polyoxyethyleneglycol and having an average molecular weight ranging from 3000 to 18000 is expressed by the general formula A given below.

General formula A:

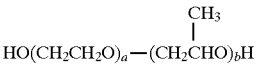

$$HO(CH_2CH_2O)_a-(CH_2\overset{\overset{CH_3}{|}}{C}HO)_bH$$

where, molecular weight is in a range from 3000 to 18000, and a/b is preferably between 1 and 14.

When the average molecular weight of the additive ingredient (A) is less than 3000 or more than 18000, sufficient improvement effect of the characteristics of high current density electrolysis cannot be attained even when the additive ingredient (A) is blended with the additive ingredient (B) described below.

Preferably, the ratio of [molar number of ethylene oxide]/[molar number of propylene oxide] in the additive ingredient (A), or the ratio of molar number, a/b, which a and b are defined by the general formula A, is in a range of from 1 to 14. If a/b exceeds 14, the plating bath gives excessive foaming to make plating difficult in the flow bath. If a/b is less than 1, the cloud point of the plating bath decreases to induce significant degradation of bath at around 40° C. which is the operating temperature of ordinary plating bath. Best performance is obtained in an a/b range of from 2.5 to 9.

The other component of the additive of the present invention, or additive ingredient (B) prepared by adding oxypropylene to polyoxyethyleneglycol and having an average molecular weight ranging from 300 to 1500 is expressed by the general formula (B) given below.

General formula B:

$$HO(CH_2CH_2O)_a-(CH_2\overset{\overset{CH_3}{|}}{C}HO)_bH$$

where, molecular weight is in a range from 300 to 1500, and a/b is preferably between 0.4 and 3.

When the average molecular weight of the additive ingredient (B) is less than 300, the formed tinplated deposit does not give favorable brightness, and the plated deposit has many pinholes. When the average molecular weight exceeds 1500, sufficient improvement effect of the characteristics of high current density electrolysis cannot be attained even when the additive ingredient (B) is blended with the additive ingredient (A) described above.

Preferably, the ratio of [molar number of ethylene oxide] /[molar number of propylene oxide] in the additive ingredient (B), or the ratio of molar number, a/b, which a and b are defined by the general formula B, is in a range of from 0.4 to 3. If a/b exceeds 3, the plating bath gives excessive foaming to make plating difficult in the flow bath. If a/b is less than 0.4, the cloud point of the plating bath decreases to induce significant degradation of bath at around 40° C. which is the operating temperature of ordinary plating bath. Best performance is obtained in an a/b range from 1.0 to 1.5.

The blending ratio of the additive ingredients (A) and (B) is in a range from 97/3 to 40/60 by weight in terms of [additive ingredient (A)]/[additive ingredient (B)]. When the weight ratio of (A)/(B) is more than 97/3 or less than 40/60, sufficient improvement effect of the characteristics of high current density electrolysis cannot be attained even when the additive ingredient (A) is added along with the low molecular weight additive ingredient (B). To attain specially superior characteristics of high current density electrolysis, the weight ratio of (A)/(B) is preferably in a range from 66/34 to 50/60.

The acidic tinplating bath according to the present invention containing above-described additive has a bath composition which uses at least one organic sulfonic acid selected from the group of alkanesulfonic acid and alkanolsulfonic acid, and containing a divalent tin salt of the organic sulfonic acid, an antioxidant, and a brightening agent, as basic components.

The reason why the above-described specified organic sulfonic acid is used as the basis component of the plating bath is that the component has low electrolytic conductivity suitable for high current density electrolysis, and that the component gives less bad influence to environment compared with ferrostanate bath. Most preferable organic sulfonic acid is MSA (methanesulfonic acid), an alkaneslufonic acid.

A preferable added quantity of the additive ingredients (A) and (B) is in a range of from 0.2 to 20 g/l as the sum of (A) and (B). If the added quantity is less than 0.2 g/l, favorable brightness of the plated deposit cannot be obtained. If the added quantity exceeds 20 g/l, the effect saturates to degrade the economy.

Phenol hydroxide and other chemicals may be applied as the antioxidant.

The electrode used in the plating process may be either the insoluble electrode or the soluble electrode. Both types of the electrode provide favorable result.

EXAMPLE

First, an example is described to test the adequacy of evaluation of performance of plating bath in terms of crystal orientation, then an example of the present invention is given on the evaluation of performance of plating bath using the crystal orientation.

[Items for the evaluation of condition of preparing specimen of the plating test and for the performance of plating bath]

Performance of various kinds of additives used in the embodiments were evaluated from the point of characteristics of high current density electrolysis of the plating bath based on the performance of plated deposit prepared in the plating bath using the additive. The plating bath for evaluating the additive used methanesulfonic acid as the organic sulfonic acid, and contained a divalent tin salt of methanesulfonic acid, antioxidant (phenol hydroxide), and the above-described additive (brightening agent), as basic components.

The method for preparing the specimen of plating test is described below.

A cold-rolled steel sheet having a thickness of 0.22 mm was treated by electrolytic alkali degreasing, washing with water, electrolytic pickling, washing with water, then was subjected to electro-tinplating using a tinplating bath using various kinds of additives.

The preliminary treatment was conducted in accordance with the condition of electro-tinplating line of steel sheet for can-production. The tinplating was conducted in flow type electrolytic cells at a condition 2 m/sec. of flow speed, 45° C. of liquid temperature, 30 to 200 A/dm$^2$ of current density, while controlling either the tin coating weight or electrolysis time. The tin coating weight was in a range of from thin tinplate used as the can-material to #100 tinplate, (or 0.5 to 11.2 g/m$^2$ of tin coating weight).

After the electro-tinplating, the specimen was washed with water and dried, and only the specimens to be subjected to evaluation item 5 and item 9 were treated by reflow. The reflow treatment was conducted by immersing the specimen into a flux, by heating the specimen by applying electric power, and by water-quenching immediately after the tin-fusion. The flux applied was aqueous solution containing 1 to 10 g/l of organic sulfonic acid which was used in the plating bath applied for the preparation of specimen for testing. The heating time by applying power was 1.5 sec. The current value was adjusted to provide the amount of alloy layer becomes nearly equal to that in commercial line.

To evaluate the characteristics of high current density electrolysis of the plating bath, the obtained specimens were evaluated by the items (1) through (5) given below.

(1) Evaluation item 1: Evaluation by crystal orientation

The plating current was changed in a range from 30 to 200 A/dm$^2$ at an interval of 5 to 20 A/dm$^2$. Plating was conducted in the same plating bath with different current densities to prepare 9 to 15 levels of plated deposits. Each of the prepared plated deposits was subjected to peak search by XRD (X-ray Diffraction ) measurement. The XRD measurement used a Cu target to give the determination under a condition of 2θ, 20° to 90°, and a rotational speed of 8°/min. From the observed peak intensity of (101) plane for a β-tin, (eq.(l) given before), and the total peak intensity, (eq.(2) given before), the orientation intensity of (101) plane of each plated deposit was determined using eq.(3) given before. Thus derived a curve correlating the orientation intensity of (101) plane of the plated deposit with the plating current density at which the deposits was plated in the same plating bath, or a curve showing the change of orientation intensity of (101) plane in the plated deposit with the increase in plating current density. The vertical axis is the orientation intensity of (101) plane, and the horizontal axis is the plating current density. The plating current density at the point that the maximum value IT of the orientation intensity of (101) plane on the curve is defined as T. The value of T is taken as the first evaluation index for the characteristics of high current density electrolysis of the plating bath, (refer to FIG. 1). That is, higher value of T means higher upper limit of the current density of the plating bath and suggests superior characteristics of high current density electrolysis.

(2) Evaluation item 2: Evaluation by crystal orientation

For the case that the T value according to the above-described evaluation item 1 is the same, the curve showing the change of orientation intensity of (101) plane of the plated deposit against the plating current density is followed to determine the point of 0.9 IT of the orientation intensity of (101) plane, corresponding to 90% of the maximum IT value. The value on the plating current density axis at the 0.9 IT point is defined as K. The K value is defined as the second evaluation index of the characteristics of high current density electrolysis of the plating bath, (refer to FIG. 2). That is, even when the T value is the same, higher T value gives more gradual decrease of the curve of change in orientation intensity of (101) plane after reached the peak value, and suggests higher upper limit of current density of the plating bath and superior in the characteristics of high current density electrolysis.

(3) Evaluation item 3: Evaluation by crystal orientation

In the case that T value and K value, or the first index and the second index, were the same for separate plated deposits, the orientation intensity of (200) plane of each plated deposit was determined from the peak intensity of (200) plane obtained from the peak search on a β-tin, (eq.(4) given below), and from the total peak intensity, (eq.(2) given before), using eq.(5) given before. Thus derived a curve correlating the orientation intensity of (200) plane of the plated deposit with the plating current density at which the deposit was plated in the same plating bath, or a curve showing the change of orientation intensity of (200) plane in the plated deposit with the increase in plating current density. The vertical axis is the orientation intensity of (200) plane, and the horizontal axis is the plating current density. The minimum value IM of the orientation intensity of (200) plane on the curve is taken as the third evaluation index for the characteristics of high current density electrolysis of the plating bath, (refer to FIG. 3). That is, even when the T value and the K value are the same in different cases, higher value of IM gives more fine and dense crystals and gives superior characteristics of high current density electrolysis.

(4) Evaluation item 4: Tin coverage

The evaluation was conducted using IEV test which was proposed by Tsurumaru, et al. of TOYO SEIKAN KAISHA, LTD. as a method for judging the degree of exposure of basis steel. According to the method, the specimen was used as the work electrode in a carbonate buffer solution at pH 10 to conduct a constant potential electrolysis at +1.2 VvsSCE, and the observed current per 1 $cm^3$ after 2 min. was defined as IEV. Larger value of IEV means poorer tin coverage. The judgment criterion was defined as "Good (o)" at 0.3 $mA/cm^2$ or less, and "Bad (x)" more than 0.3 $mA/cm^2$.

(5) Evaluation item 5: ATC test

ATC (Alloy-Tin Couple) test is a testing method on quality (corrosion resistance) of alloy layer on tinplate. Since the correlation of the test result with the corrosion resistance of commercial cans was proved, the test method is commonly adopted by the can material field. According to the method, the specimen treated by reflow is dealt with, and the specimen on which the tin as the surface layer was removed while leaving the tin-iron alloy layer is coupled with metallic tin in an environment of grape fruit juice which was deaerated and which is at 25° C. to determine the current ($\mu A/cm^2$). The test requires the ATC value at 0.12 $\mu A/cm^2$ or less for a tinplate with 5.6 $g/m^2$ of coating weight. The ATC value of not higher than 0.12 $\mu A/cm^2$ is judged as "Good (o)", and ATC value of higher than 0.12 $\mu A/cm^2$ is judged as "Bad (x)".

As for the characteristics of plating bath, the following evaluation items (6) through (8) were given.

(6) Evaluation item 6: Evaluation of foaming property

A transparent resin vessel having a size of 20 cm×20 cm×60 cm was used to maintain the liquid level at 40 cm from the top edge of the vessel. The liquid was circulated at a rate of 1 liter/sec. and at a speed of 2 m/sec. The evaluation was given by the height of generated foam.

If the foam height exceeds 40 cm, commercial operation may be hindered. Accordingly, the foam height below 20 cm is defined as "Good (◎)", the foam height of 20 cm or more and less than 40 cm is defined as "Fair (o)", the foam height of more than 40 cm is defined as "Acceptable (Δ)".

(7) Evaluation item 7: Evaluation by current efficiency

After plating at a plating current density of 30 to 200 $A/cm^2$, the tin coating weight was measured conforming to JIS G3303 to determine the current efficiency during tin-plating. A current efficiency of 80% or more is defined as "Good(o)", and that of less than 80% is defined as "Bad (x)".

(8) Evaluation item 8: Evaluation of cloud point

Plating liquid was sampled to a 300 cc transparent glass beaker. The cloud point was determined by heating the liquid at a speed of 2° C./min. of temperature increase under agitation. Since the cloud point below 45° C. induces significant limitation in commercial operation, the cloud point at 45° C. or above is defined as "Good (o)", and that below 45' C. is defined as "Acceptable (Δ)".

As a comparison on the evaluation item on characteristics of high current density electrolysis of plating bath, the prepared specimens were subjected to the evaluation item 9 described below.

(9) Evaluation item 9: Evaluation on the basis of brightness of specimen treated by reflow After plating at a current density ranging from 30 to 200 $A/dm^2$, the reflow-treated specimen was observed on its surface under SEM. The specimen which shows no untreated reflow zone and which gives over 800 of gloss was defined as "Good brightness". Five specimens were prepared for each test condition. The evaluation criterion for the characteristics of high current density electrolysis was selected in a current density range from the maximum electrolytic current density which gives good brightness for all of the five specimens tested to the minimum electrolytic current density which gives bad brightness for all of the five specimens tested.

Table 1 shows the bath compositions used for the study of evaluation of performance of plating bath by crystal orientation. The additives and the antioxidants used in these bath compositions are used in commercially available solder (tin-lead alloy solder). Table 2 shows the evaluation result on the plating baths given in Table 1 in accordance with the evaluation items 1 through 5, and 9. As seen in the comparison of the evaluation items 1 through 3 and the evaluation items 4, 5, and 9, the evaluation result of characteristics of high current density electrolysis of plating bath by the crystal orientation in plated deposit gives a high accuracy agreement with the evaluation result based on the post-reflow brightness and the evaluation result on the corrosion resistance.

From the above-described results, the evaluation on the characteristics of high current density electrolysis by the crystal orientation in plated deposit was confirmed to give an accurate evaluation result independent of the kinds of additives and the composition of plating bath.

TABLE 1

| Bath composition | Component | Concentration |
|---|---|---|
| Composition 1 | Divalent tin ion | 60 g/l |
| | Methane sulfonic acid | 40 g/l (converted to sulfuric acid) |
| | aromatic additive *1 | 20 ml/l |
| | Antioxidant | 10 ml/l |
| Composition 2 | Divalent tin ion | 130 g/l |
| | Methane sulfonic acid | 40 g/l (converted to sulfuric acid) |
| | Aliphatic additive *1 | 20 ml/l |
| | Antioxidant | 10 ml/l |
| Composition 3 | Divalent tin ion | 30 g/l |
| | Methane sulfonic acid | 20 g/l (converted to sulfuric acid) |
| | Aliphatic additive *1 | 20 ml/l |
| | Antioxidant | 10 ml/l |
| Composition 4 | Divalent tin ion | 60 g/l |
| | Methane sulfonic acid | 40 g/l (converted to sulfuric acid) |
| | Aliphatic additive *1 | 20 ml/l |
| | Antioxidant | 10 ml/l |
| Composition 5 | Divalent tin ion | 60 g/l |
| | Methane sulfonic acid | 40 g/l (converted to sulfuric acid) |
| | Aliphatic additive *1 | 20 ml/l |
| | Antioxidant | 20 ml/l |

*1 Brightening agent evaluation item 1, and gives high upper limit current density compared with the existing plating bath shown in Table 2.

Comparative example 4 is the one in which the average molecular weight of each of the additive ingredient (A) and the additive ingredient (B) exceeds the upper limit of the present invention. Comparative example 4 gives low index value (T value) of the upper limit of current density conforming to the evaluation item 1, thus giving poor brightness of tinplated deposit.

Comparative example 5 is the one in which the average molecular weight of each of the additive ingredient (A) and the additive ingredient (B) is less than the lower limit of the present invention. Compared with the examples of the present invention, also Comparative example 5 gives low index value (T value) of the upper limit of current density conforming to the evaluation item 1, thus giving poor brightness and tin-coverage.

Comparative example 6 and Comparative example 7 are the ones in which the blending ratio (by weight) of the additive ingredient (A) to the additive ingredient (B) is outside of the range of the present invention. Both Comparative example 6 and Comparative example 7 cannot give improving effect of characteristics of high current density electrolysis by adding both the high molecular weight additive ingredient and the low molecular weight additive ingredient, thus resulting in low index value (T value) of the upper limit current density conforming to evaluation item 1, and in poor brightness of tinplated deposit.

Each of Comparative examples 1, 2, and 8 through 11 is the one to which only either of the high molecular weight additive ingredient (A) or the low molecular weight additive ingredient (B) is added. All of these Comparative examples cannot attain the effect to obtain the improvement in the characteristics of high current density electrolysis attained by adding both the high molecular weight additive ingredient and the low molecular weight additive ingredient. As a result, the index value (T value) of the upper limit of current density conforming to the evaluation item 1 became low, and the brightness of tinplated deposit became poor.

TABLE 2

| | Evaluation item 1 | Evaluation item 2 | Evaluation item 3 | Evaluation item 9 | Performance of material which was plated at a plating current density of T value in accordance with the evaluation item 1*1 | |
|---|---|---|---|---|---|---|
| Bath composition | (A/dm$^2$) | (A/dm$^2$) | (%) | (A/dm$^2$) | Evaluation item 4 | Evaluation item 5 |
| Composition 1 | 50 | 90 | 5 | 50–80 | ○ | ○ |
| Composition 2 | 80 | 140 | Not determined | 80–140 | ○ | ○ |
| Composition 3 | 30 | 50 | Not determined | 40–70 | ○ | ○ |
| Composition 4 | 40 | 70 | Not determined | 40–60 | ○ | ○ |
| Composition 5 | 50 | 90 | 40 | 50–100 | ○ | ○ |

*1 ○: Good, x: Bad

The examples of the present invention is described below along with the evaluation results in accordance with the above-described evaluation items 1 through 8.

The examples used the tinplating bath having the basis composition shown in Table 3. The additive (brightening agent) applied was prepared by adding oxypropylene to polyoxyethyleneglycol. The detail of bath composition in each example including the applied additive ingredient is given in Tables 4 through 6. The evaluation result in each example is given in Table 7 and Table 8

As understood from the comparison of Examples 1 through 13 and compositions 4 and 5 in Table 2, when the tin concentration in the plating bath is equal for the separate baths, the plating bath including the additive according to the present invention gives 60 or more of the index value (T value) of the upper current density conforming to the Comparative example 3 is the one in which the total amount of additives [additive ingredient (A) +additive ingredient (B)] is below the lower limit of the present invention. Thus, the attained index value (T value) of the upper limit of current density in accordance with the evaluation item 1 was only a level equivalent to that of existing plating bath shown in the compositions 4 and 5 in Table 2.

Contrary to the above-described Comparative examples, Examples according to the present invention give high index value (T value) of the upper limit of current density in accordance with the evaluation item 1, and provide excellent characteristics of high current density electrolysis.

According to the present invention, a preferred range of the ratio of [molar number of ethylene oxide]/[molar number of propylene oxide] in each of the additive ingredients is 1 to 14 for the additive ingredient (A), and 0.4 to 3 for the additive ingredient (B). Examples 12 and 13 according to the present invention are the ones in which the ratio of the molar numbers is outside of the above-described preferred range. Accordingly, the foamability or cloud point of the plating bath is inferior to Examples 4 and 5. Thus these Examples cannot be used as the plating bath, though the brightness effect is attained.

As understood from the comparison of Examples 4 and 8 with Example 10, the most preferable range of the above-described molar number of the additive ingredient (B) in terms of evaluation on foaming property and on cloud point is from 1.0 to 1.5. As seen in Examples 1, 3, 9, 10, and 11 according to the present invention, the most preferable range of the blending ratio of [additive ingredient (A)]/[additive ingredient (B)] is from 66/34 to 50/50.

Also for the ratio of the above-described molar number of [additive ingredient (A)], the most preferable range is from 2.5 to 9 as understood from the comparison between Examples 4 and 8 and Example 10.

According to the additive for tinplating bath and to the tinplating bath using the additive according to the present invention, the characteristics of high current density electrolysis of the acid tinplating bath with specified organic sulfonic acid basis to approximately 1.5 times those in the conventional plating baths, thus the operability of the tinplating is significantly improves compared with conventional one. Furthermore, the present invention offers the reduction of investment cost for line construction.

TABLE 3

| Basis bath composition No. | Composition | Concentration |
|---|---|---|
| (1) | Divalent tin ion | 60 g/l |
| | Methane sulfonic acid | 40 g/l (converted to sulfuric acid) |
| | Aliphatic additive *1 | adequate amount |
| | Antioxidant | 3 g/l |
| (2) | Divalent tin ion | 30 g/l |
| | Methane sulfonic acid | 20 g/l (converted to sulfuric acid) |
| | Aliphatic additive *1 | adequate amount |
| | Antioxidant | 3 g/l |

*1; Brightening agent

TABLE 4

| No. | Basis bath composition *1 | Additive (brightening agent) *2 | Ingredient (A) | Ingredient (B) | (A)/(B) |
|---|---|---|---|---|---|
| Example 1 | (1) | Added amount (g/l) | 10 | 10 | 50/50 |
| | | Average molecular weight | 15000 | 1200 | |
| | | a/b | 4 | 1.3 | |
| Example 2 | (1) | Added amount (g/l) | 0.15 | 0.15 | 50/50 |
| | | Average molecular weight | 15000 | 1200 | |
| | | a/b | 4 | 1.3 | |
| Example 3 | (1) | Added amount (g/l) | 9 | 9 | 50/50 |
| | | Average molecular weight | 15000 | 1200 | |
| | | a/b | 4 | 1.3 | |
| Example 4 | (1) | Added amount (g/l) | 10 | 10 | 50/50 |
| | | Average molecular weight | 15000 | 1100 | |
| | | a/b | 2 | 0.5 | |
| Example 5 | (1) | Added amount (g/l) | 10 | 10 | 50/50 |
| | | Average molecular weight | 15000 | 1200 | |
| | | a/b | 12 | 2.5 | |
| Example 6 | (1) | Added amount (g/l) | 10 | 10 | 50/50 |
| | | Average molecular weight | 17000 | 1200 | |
| | | a/b | 4 | 1.3 | |
| Example 7 | (1) | Added amount (g/l) | 10 | 10 | 50/50 |
| | | Average molecular weight | 3500 | 1400 | |
| | | a/b | 4 | 1.3 | |
| Example 8 | (1) | Added amount (g/l) | 10 | 10 | 50/50 |
| | | Average molecular weight | 7000 | 800 | |
| a/b | 12 | 2.5 | | | |
| Example 9 | (1) | Added amount (g/l) | 18 | 2 | 90/10 |
| | | Average molecular weight | 10000 | 1000 | |
| | | a/b | 4 | 1.3 | |

*1 Basis bath composition No. given in Table 3.
*2 a/b: [molar number of ethylene oxide]/[molar number of propylene oxide]

TABLE 5

| No. | Basis bath composition *1 | Additive (brightening agent) *2 | Ingredient (A) | Ingredient (B) | (A)/(B) |
|---|---|---|---|---|---|
| Example 10 | (1) | Added amount (g/l) | 9 | 11 | 45/55 |
| | | Average molecular weight | 10000 | 1000 | |
| | | a/b | 4 | 1.3 | |
| Example 11 | (1) | Added amount (g/l) | 13 | 7 | 65/35 |
| | | Average molecular weight | 15000 | 1100 | |
| | | a/b | 4 | 0.5 | |
| Example 12 | (1) | Added amount (g/l) | 10 | 10 | 50/50 |
| | | Average molecular weight | 15000 | 1000 | |
| | | a/b | 0.5 | 0.1 | |
| Example 13 | (1) | Added amount (g/l) | 10 | 10 | 50/50 |
| | | Average molecular weight | 15000 | 1200 | |
| | | a/b | 16 | 4 | |
| Example 14 | (2) | Added amount (g/l) | 10 | 10 | 50/50 |
| | | Average molecular weight | 14000 | 1100 | |
| | | a/b | 4 | 0.5 | |
| Example 15 | (2) | Added amount (g/l) | 13 | 7 | 65/35 |
| | | Average molecular weight | 14000 | 1100 | |
| | | a/b | 4 | 0.5 | |
| Comparative Example 1 | (1) | Added amount (g/l) | — | 20 | 0/100 |
| | | Average molecular weight | | 1200 | |
| | | a/b | | 1.3 | |
| Comparative Example 2 | (1) | Added amount (g/l) | 20 | — | 100/0 |
| | | Average molecular weight | 15000 | | |
| | | a/b | 4 | | |
| Comparative Example 3 | (1) | Added amount (g/l) | 0.07 | 0.07 | 50/50 |
| | | Average molecular weight | 15000 | 1200 | |
| | | a/b | 4 | 1.3 | |

*1 Basis bath composition No. given in Table 3.
*2 a/b: [molar number of ethylene oxide]/[molar number of propylene oxide]

TABLE 6

| No. | Basis bath composition *1 | Additive (brightening agent) *2 | Ingredient (A) | Ingredient (B) | (A)/(B) |
|---|---|---|---|---|---|
| Comparative Example 4 | (1) | Added amount (g/l) | 10 | 10 | 50/50 |
| | | Average molecular weight | 22000 | 2500 | |
| | | a/b | 4 | 1.3 | |
| Comparative Example 5 | (1) | Added amount (g/l) | 10 | 10 | 50/50 |
| | | Average molecular weight | 2500 | 200 | |
| | | a/b | 4 | 1.3 | |
| Comparative Example 6 | (1) | Added amount (g/l) | 7 | 13 | 35/65 |
| | | Average molecular weight | 15000 | 1200 | |
| | | a/b | 4 | 1.3 | |
| Comparative Example 7 | (1) | Added amount (g/l) | 19.5 | 0.5 | 97.5/2.5 |
| | | Average molecular weight | 15000 | 1200 | |
| | | a/b | 4 | 1.3 | |
| Comparative Example 8 | (2) | Added amount (g/l) | — | 20 | 0/100 |
| | | Average molecular weight | | 1100 | |
| | | a/b | | 0.5 | |
| Comparative Example 9 | (2) | Added amount (g/l) | 20 | — | 100/0 |
| | | Average molecular weight | 14000 | | |
| | | a/b | 4 | | |
| Comparative Example 10 | (2) | Added amount (g/l) | — | 20 | 0/100 |
| | | Average molecular weight | | 1100 | |
| | | a/b | | 1.5 | |
| Comparative Example 11 | (2) | Added amount (g/l) | — | 20 | 0/100 |
| | | Average molecular weight | | 1100 | |
| | | a/b | | 1 | |

*1 Basis bath composition No. given in Table 3.
*2 a/b: [molar number of ethylene oxide]/[molar number of propylene oxide]

TABLE 7

| No. | Evaluation item 1 (A/dm$^2$) | Evaluation item 2 (A/dm$^2$) | Evaluation item 3 (%) | Performance of material which was plated at a plating current density of T value in accordance with the evaluation item 1*1 | | | | | Remarks*2 |
|---|---|---|---|---|---|---|---|---|---|
| | | | | Evaluation item 4 | Evaluation item 5 | Evaluation item 6 | Evaluation item 7 | Evaluation item 8 | |
| Example 1 | 70 | 120 | 10 | ○ | ○ | ◎ | ○ | ○ | (1) |
| Example 2 | 60 | 100 | Not determined | ○ | ○ | ◎ | ○ | ○ | (1) |
| Example 3 | 70 | 120 | 9 | ○ | ○ | ◎ | ○ | ○ | (1) |
| Example 4 | 70 | 100 | Not determined | ○ | ○ | ◎ | ○ | ○ - Δ | (1) |
| Example 5 | 70 | 120 | 4 | ○ | ○ | ◎ | ○ | ○ | (1) |
| Example 6 | 70 | Not determined | Not determined | ○ | ○ | ◎ | ○ | ○ | (1) |
| Example 7 | 60 | Not determined | Not determined | ○ | ○ | ◎ | ○ | ○ | (1) |
| Example 8 | 60 | Not determined | Not determined | ○ | ○ | ○ | ○ | ○ | (1) |
| Example 9 | 70 | 110 | 3 | ○ | ○ | ◎ | ○ | ○ | (1) |
| Example 10 | 70 | 110 | 4 | ○ | ○ | ◎ | ○ | ○ | (1) |
| Example 11 | 80 | 130 | 10 | ○ | ○ | ◎ | ○ | ○ | (1) |
| Example 12 | 60 | 110 | Not determined | ○ | ○ | ◎ | ○ | Δ | (1) |
| Example 13 | 60 | 110 | Not determined | ○ | ○ | Δ | ○ | ○ | (1) |
| Example 14 | 50 | 80 | Not determined | ○ | ○ | ◎ | ○ | ○ | (2) |
| Example 15 | 50 | 90 | Not determined | ○ | ○ | ◎ | ○ | ○ | (2) |

*1 ◎: Good, ○: Fair, Δ: Acceptable, x: Bad
*2 Basis bath composition No. given in Table 3.

TABLE 8

| No. | Evaluation item 1 (A/dm$^2$) | Evaluation item 2 (A/dm$^2$) | Evaluation item 3 (%) | Performance of material which was plated at a plating current density of T value in accordance with the evaluation item 1*1 | | | | | Remarks*2 |
|---|---|---|---|---|---|---|---|---|---|
| | | | | Evaluation item 4 | Evaluation item 5 | Evaluation item 6 | Evaluation item 7 | Evaluation item 8 | |
| Example 1 | 50 | Not determined | Not determined | ○ | ○ | ◎ | ○ | ○ | (1) |
| Example 2 | 50 | Not determined | Not determined | ○ | ○ | ○ | ◎ | ○ | ○(1) |
| Example 3 | 40 | Not determined | Not determined | ○ | ○ | ◎ | ○ | ○ | (1) |
| Example 4 | 50 | Not determined | Not determined | ○ | ○ | ◎ | ○ | ○ | (1) |
| Example 5 | 40 | Not determined | Not determined | x | ○ | ◎ | ○ | ○ | (1) |
| Example 6 | 40 | Not determined | Not determined | ○ | ○ | ◎ | ○ | ○ | (1) |
| Example 7 | 50 | Not determined | Not determined | ○ | ○ | ◎ | ○ | ○ | (1) |
| Example 8 | 30 | Not determined | Not determined | ○ | ○ | ◎ | ○ | Δ | (2) |
| Example 9 | 40 | Not determined | Not determined | ○ | ○ | ◎ | ○ | ○ | (2) |
| Example 10 | Not determined | Not determined | Not determined | Not determined | Not determined | ◎ | Not determined | ○ | (2) |
| Example 11 | Not determined | Not determined | Not determined | Not determined | Not determined | ◎ | Not determined | ○ | (2) |

*1 ◎: Good, ○: Fair, Δ: Acceptable, x: Bad
*2 Basis bath composition No. given in Table 3.

What is claimed is:

1. An acidic tin-plating bath for electroplating tin to a continuously moving steel sheet, the acidic tinplating bath comprising:

a divalent tin salt of an organic sulfonic acid using at least one organic sulfonic acid selected from the group consisting of alkanesulfonic acid and alkanolsulfonic acid;

an antioxidant; and a brightening agent comprising:

an additive ingredient (A) prepared by adding oxypropylene to polyoxyethylene glycol and having an average molecular weight ranging from 3000 to 18000;

an additive ingredient (B) prepared by adding oxypropylene to polyoxyethylene glycol and having an average molecular weight ranging from 300 to 1500;

the additive ingredient (A) and the additive ingredient (B) having a weight ratio of the additive ingredient (A) to the additive ingredient (B) being from 97/3 to 40/60, the brightening agent being contained in an amount of from 0.2 to 20 g/liter of the acidic tin-plating bath.

2. The acidic tin-plating bath of claim 1, wherein the additive ingredient (A) has a ratio of molar number of ethylene oxide to molar number of propylene oxide being from 1 to 14;

the additive ingredient (B) has a ratio of molar number of ethylene oxide to molar number of propylene oxide being from 0.4 to 3.

3. The acidic tin-plating bath of claim 1, wherein said at least one organic sulfonic acid is methanesulfonic acid.

4. The acidic tinplating bath of claim 1, wherein said antioxidant is phenol hydroxide.

5. In a method for electroplating tin to a continuously moving steel sheet the improvement which comprises:

electroplating tin from an acidic tin-plating bath containing a divalent tin salt of an organic sulfonic acid using at least one organic sulfonic acid selected from the group consisting of alkanesulfonic acid and alkanolsulfonic acid, and an additive comprising an additive ingredient (A) prepared by adding oxypropylene to polyoxyethylene glycol and having an average molecular weight ranging from 3000 to 18000;

an additive ingredient (B) prepared by adding oxypropylene to polyoxyethylene glycol and having an average molecular weight ranging from 300 to 1500; and the additive ingredient (A) and the additive ingredient (B) having a weight ratio of the additive ingredient (A) to the additive ingredient (B) being from 97/3 to 40/60.

* * * * *